US012098663B2

(12) United States Patent
Smerczak

(10) Patent No.: US 12,098,663 B2
(45) Date of Patent: Sep. 24, 2024

(54) HYDRAULIC VCT END PLATE SEAL

(71) Applicant: BorgWarner Inc., Auburn Hills, MI (US)

(72) Inventor: John R. Smerczak, Ortonville, MI (US)

(73) Assignee: BorgWarner Inc., Auburn Hills, MI (US)

( * ) Notice: Subject to any disclaimer, the term of this patent is extended or adjusted under 35 U.S.C. 154(b) by 110 days.

(21) Appl. No.: 18/116,381

(22) Filed: Mar. 2, 2023

(65) Prior Publication Data

US 2023/0279790 A1 Sep. 7, 2023

Related U.S. Application Data

(60) Provisional application No. 63/315,761, filed on Mar. 2, 2022.

(51) Int. Cl.
*F01L 1/34* (2006.01)
*F01L 1/344* (2006.01)

(52) U.S. Cl.
CPC ... *F01L 1/3442* (2013.01); *F01L 2001/34479* (2013.01)

(58) Field of Classification Search
CPC ..... F01L 1/3442; F01L 2001/34479; F01L 2303/00; F01L 2001/34483; F01L 1/047
USPC ..... 123/90.17
See application file for complete search history.

(56) References Cited

U.S. PATENT DOCUMENTS

| | | | | |
|---|---|---|---|---|
| 9,695,716 | B2 * | 7/2017 | Smith | F01L 1/3442 |
| 10,371,019 | B2 * | 8/2019 | Watanabe | F01L 1/047 |
| 10,914,203 | B2 * | 2/2021 | Arai | F01L 1/348 |
| 2011/0061616 | A1 * | 3/2011 | Watanabe | F01L 1/02 123/90.15 |
| 2020/0386124 | A1 * | 12/2020 | Li | F01L 1/047 |

FOREIGN PATENT DOCUMENTS

| | | | | |
|---|---|---|---|---|
| CN | 110017185 A | * | 7/2019 | |
| EP | 2631439 B1 | * | 4/2015 | F01L 1/34 |

* cited by examiner

*Primary Examiner* — Kenneth J Hansen
*Assistant Examiner* — Kelsey L Stanek
(74) *Attorney, Agent, or Firm* — Reising Ethington P.C.

(57) ABSTRACT

A hydraulically-actuated variable camshaft timing (VCT) assembly, including a stator having one or more fluid chambers; a rotor received by the stator, and configured to be angularly displaced relative to the stator, having one or more radially extending vanes positioned within the fluid chambers; one or more end plates coupled with the stator and at least partially defining the fluid chambers; and an end plate seal abutting the end plate(s) and the radial surface of the rotor.

11 Claims, 3 Drawing Sheets

HYDRAULIC VCT END PLATE SEAL

TECHNICAL FIELD

The present application relates to internal combustion engines (ICEs) and, more particularly, to variable camshaft timing assemblies used with ICEs.

BACKGROUND

Internal combustion engines (ICEs) use one or more camshafts to actuate valves. The camshafts are rotationally connected to the crankshaft. However, ICE performance can be improved by changing the angular position of the camshaft relative to the crankshaft. One way of changing the angular position is by using a variable camshaft timing (VCT) assembly. VCT assemblies can be controlled hydraulically using a rotor that can be angularly displaced relative to a stator. However, fluidic pressure exerted on the VCT assembly can result in fluid leaks. It would be helpful to decrease the occurrence of fluid escape from VCT assemblies.

SUMMARY

According to one aspect of the disclosure, a hydraulically-actuated variable camshaft timing (VCT) assembly includes a stator having one or more fluid chambers; a rotor received by the stator, and configured to be angularly displaced relative to the stator, having one or more radially extending vanes positioned within the fluid chambers; one or more end plates coupled with the stator and at least partially defining the fluid chambers; and an end plate seal abutting the end plate(s) and the radial surface of the rotor.

According to another aspect of the disclosure, a hydraulically-actuated VCT assembly includes a stator having one or more fluid chambers; a rotor received by the stator, and configured to be angularly displaced relative to the stator, having one or more radially extending vanes positioned within the fluid chambers; one or more end plates coupled with the stator and at least partially defining the fluid chambers; a seal groove, having an angled planar surface, formed in the one or more end plates; and an end plate seal received within the seal groove abutting the angled planar surface and a radial surface of the rotor.

DETAILED DESCRIPTION

A hydraulically-actuated variable camshaft timing (VCT) assembly, sometimes referred to as a camshaft phaser, can change the angular position of a camshaft relative to a crankshaft of an internal combustion engine. Hydraulically-actuated camshaft phasers can include a stator, a rotor rotatably movable relative to the stator, and one or more end plates that prevent the escape of fluid from the phaser. In the past, the dimensions of these components have been precisely specified such that, when assembled, the end plates prevent fluid from escaping the phaser. However, as engine manufacturers seek to improve efficiency of internal combustion engines, the manufacturers may reduce oil pressure generated by the oil pump as part of an effort to reduce parasitic losses. In certain circumstances, the hydraulically-actuated camshaft phaser may not receive sufficient oil pressure for optimal phasing and draw air into its fluid chambers rather than engine oil. While the precisely-specified dimensions of the phaser may be effective at controlling the flow of fluid between the hydraulically-actuated camshaft phaser components, the absence of engine oil under low-pressure supply from an engine oil pump may permit the introduction of air into the fluid chambers, such as from the crankcase.

An end plate seal can be added in between a radial face of the rotor and an end plate to prevent the introduction of air into a fluid chamber of the hydraulically-actuated camshaft phaser. In some implementations, the end plate seal can be shaped in a way that transmits pressure exerted on the radial face of the rotor through the seal in both an axial and radial direction. Further, the end plate seal can include a fluid groove that fluidly communicates engine oil from one fluid chamber to another fluid chamber. And the fluid groove may be shaped to have a planar surface that is angled relative to the radial face of the rotor. The angled planar surface can be positioned such that it closely conforms to a shaped end plate seal. When engine oil pressure supplied to the hydraulically-actuated camshaft phaser falls below a particular threshold, the phaser can draw engine oil from one fluid chamber and communicate that fluid to another chamber through a rotor fluid pathway thereby preventing the introduction of air into the phaser.

Figure 1:
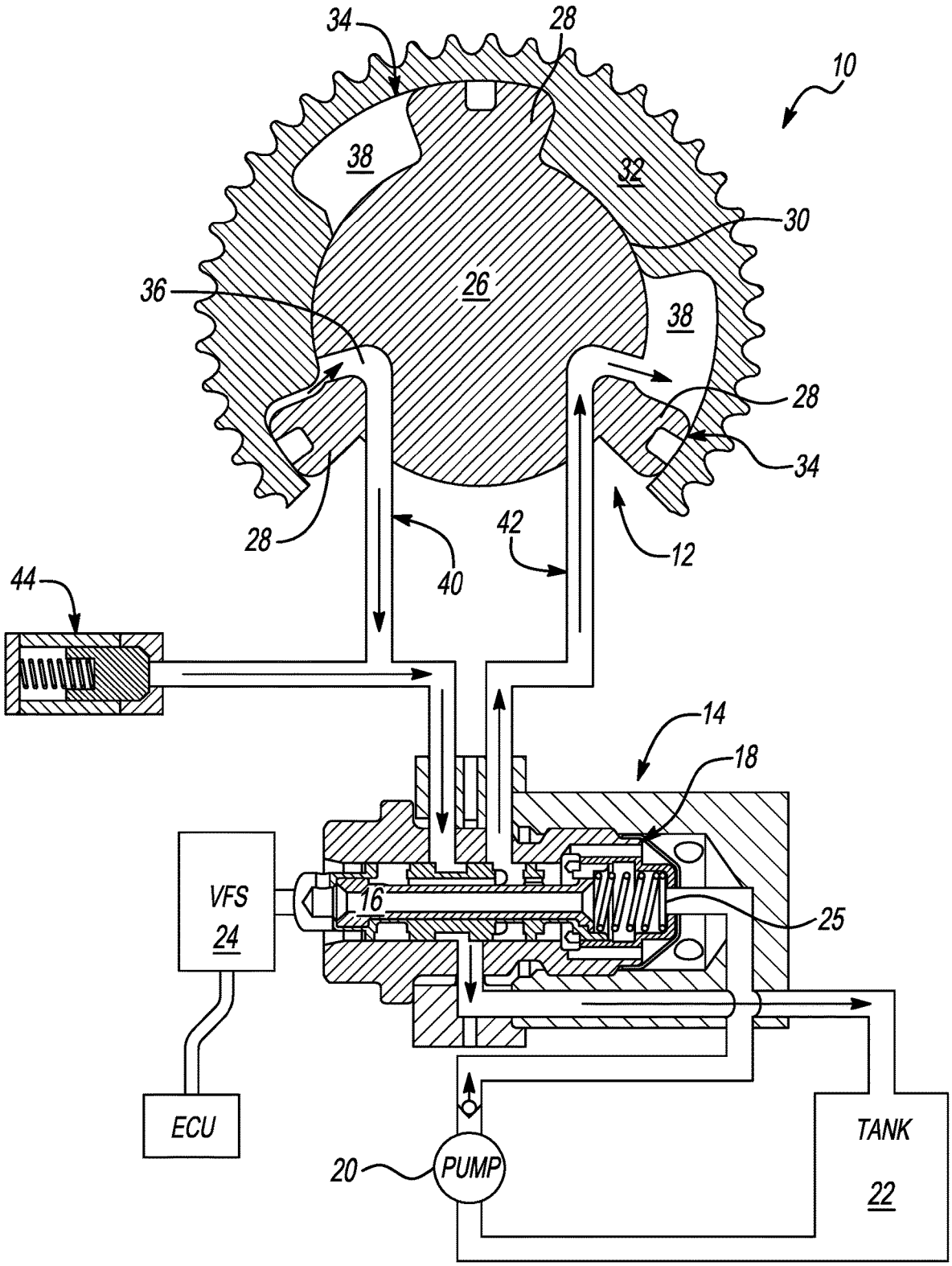
FIG. 1 is a perspective cross-sectional view depicting an implementation of a portion of a hydraulically-actuated Variable Camshaft Timing (VCT) system.

One implementation of a hydraulically-actuated variable camshaft timing (VCT) system 10 is shown in FIG. 1. The system includes a hydraulically-actuated VCT assembly 12, a spool valve 14 having a spool 16 and a sleeve or bolt 18 that receives the spool 16, a pump 20 supplying pressurized fluid to the spool valve 14, and a fluid tank 22 that receives supplies fluid and receives exhaust fluid. The system 10 also includes a variable force solenoid (VFS) 24 that axially moves the spool 16 relative to the sleeve 18 in opposition to a spring 25 to control the flow of fluid within the system 10. The VCT assembly 12 includes a rotor 26 having, in this implementation, a plurality of vanes 28 that extend radially outwardly from a hub 30 and a stator 32 that receives the rotor 26. The vanes 28 can extend into fluid chambers 34 formed in the stator 32 separating the fluid chambers 34 into an advancing chamber 36 and a retarding chamber 38. An advancing fluid pathway 40 can fluidly communicate with the advancing chamber 36 while a retarding fluid pathway 42 can fluidly communicate with the retarding chamber 38. Flow of fluid into and out of the advancing fluid pathway 40 and the retarding fluid pathway 42 can exert force on the rotor 26 through the vanes 28, selectively rotating or holding the rotor 26 relative to the stator 32. An example of a hydraulically-actuated camshaft VCT system is described in application Ser. No. 14/840,683 that ultimately issued as U.S. Pat. No. 9,695,716, the contents of which are hereby incorporated by reference. The hydraulically-actuated VCT system 10 can adjust the VCT assembly 12 in reaction to fluid under pulsation from camshaft rotation, fluid that is pressurized by the pump 20, or both. One or more check valves can control the flow of fluid under pulsation. The check valves can be implemented in a variety of ways, such as using as ball valves or reed valves. A hydraulically-actuated lock 44 can selectively fix the angular position of the rotor 26 relative to the stator 32.

Figure 2:
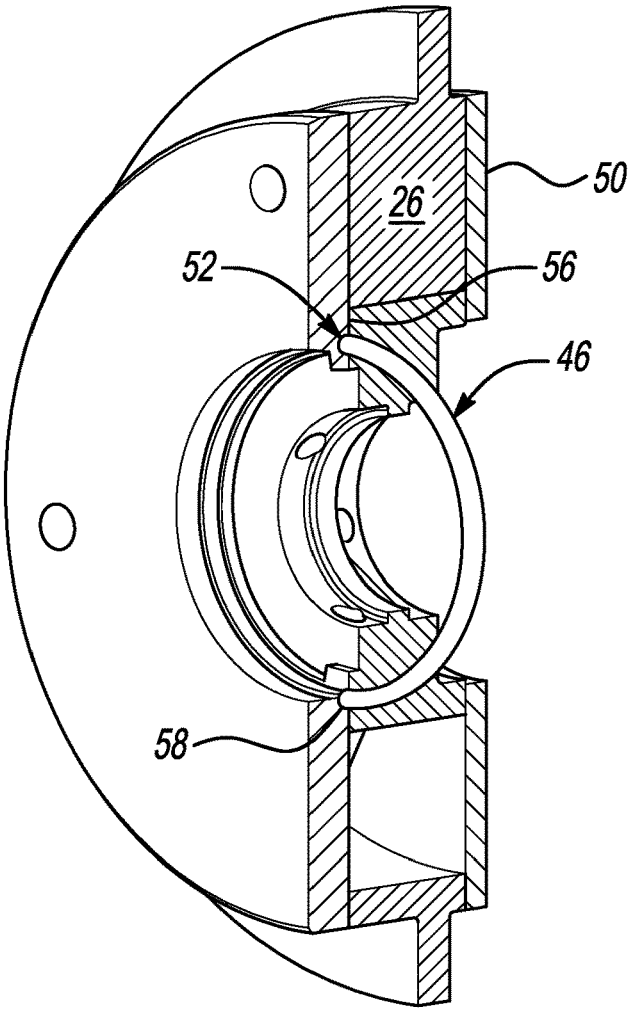
FIG. 2 is a perspective cross-sectional view depicting an implementation of a hydraulically-actuated VCT camshaft phaser including an end plate seal.
Figure 3:
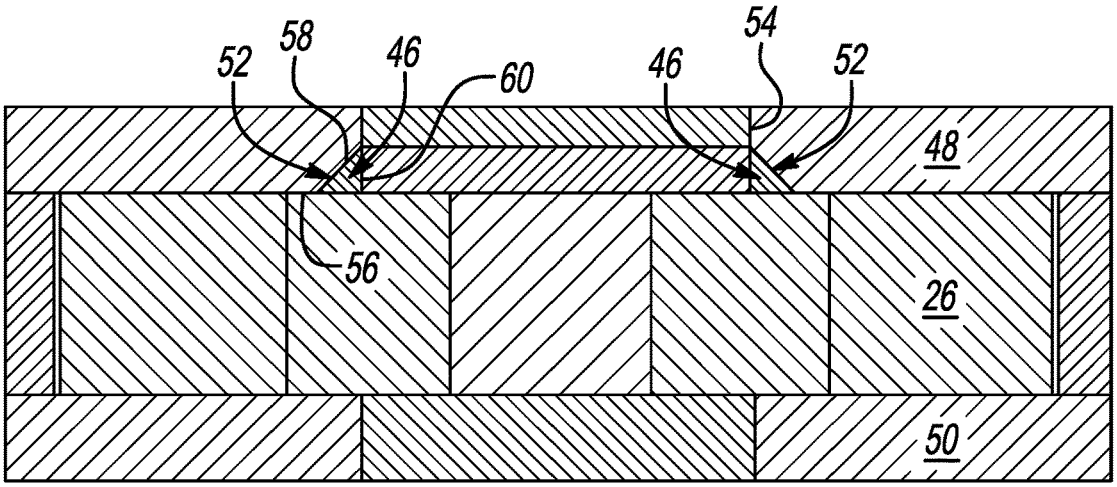
FIG. 3 is a cross-sectional view depicting an implementation of a hydraulically-actuated VCT camshaft phaser including an end plate seal.
Figure 4:
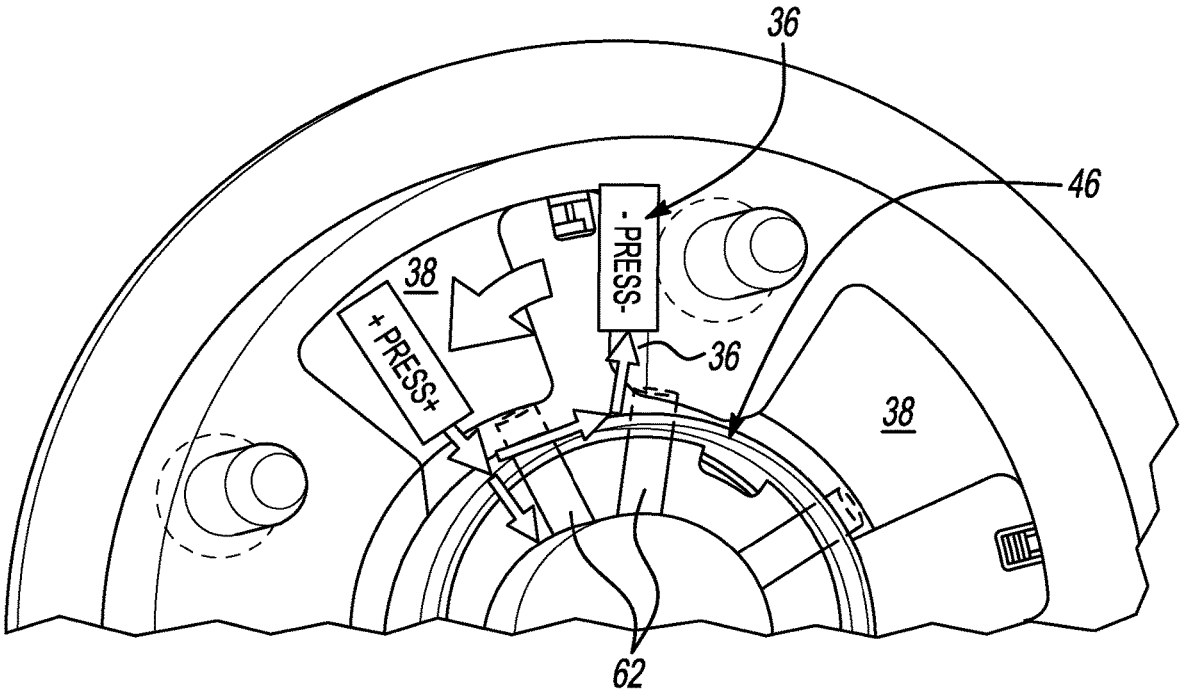
FIG. 4 is a perspective cross-sectional view depicting an implementation of a portion of a hydraulically-actuated VCT camshaft phaser including an implementation of an end plate seal.

Turning to FIGS. 2-4, the hydraulically-actuated camshaft phaser 12 is shown with the rotor 26 and an implementation of an end plate seal 46. The camshaft phaser includes a first end plate 48 and a second end plate 50 axially spaced along an axis of camshaft rotation and positioned on opposite sides of the rotor 26. In this implementation, the first end plate 48 can include a seal groove 52 extending circumferentially along an inner diameter 54 of the end plate 48. The seal groove 52 can be shaped to have a substantially planar surface 58 that is angled away from a radial surface 56 of the rotor 26. It is possible to create the seal groove 52 by chamfering the inner diameter 54 of the end plate 48. In some implementations, the end plate seal 46 can be shaped to closely conform to the radial surface 56 of the rotor 26 and the planar surface 58 of the seal groove 52. In one implementation, the end plate seal 46 can include a substantially triangular cross-section with outer surfaces that abut the radial surface 56 and the planar surface 58 as shown in FIG. 3. In other implementations, the end plate seal can have a substantially circular cross section as shown in FIG. 2 and, once compressed between the radial surface 56 of the rotor 26 and the planar surface 58 of the seal groove 52, contacts both surfaces 56, 58. An inner diameter 60 of the end plate seal 46 can engage an outer diameter of a camshaft (not shown) or an outer diameter of a fixture (not shown). While this implementation depicts one end plate seal 46, it should be appreciated that other implementations are possible in which a second end plate seal is included with the phaser 12 in between the rotor 26 and the second end plate 50, with a second seal groove formed in the second end plate 50.

The end plate seal 46 can be formed from a variety of different materials. In some implementations, the end plate seal 46 can be made from glass-filled nylon. However, a number of different materials are possible including a polymer, such as Teflon™, or metal.

Figure 5:
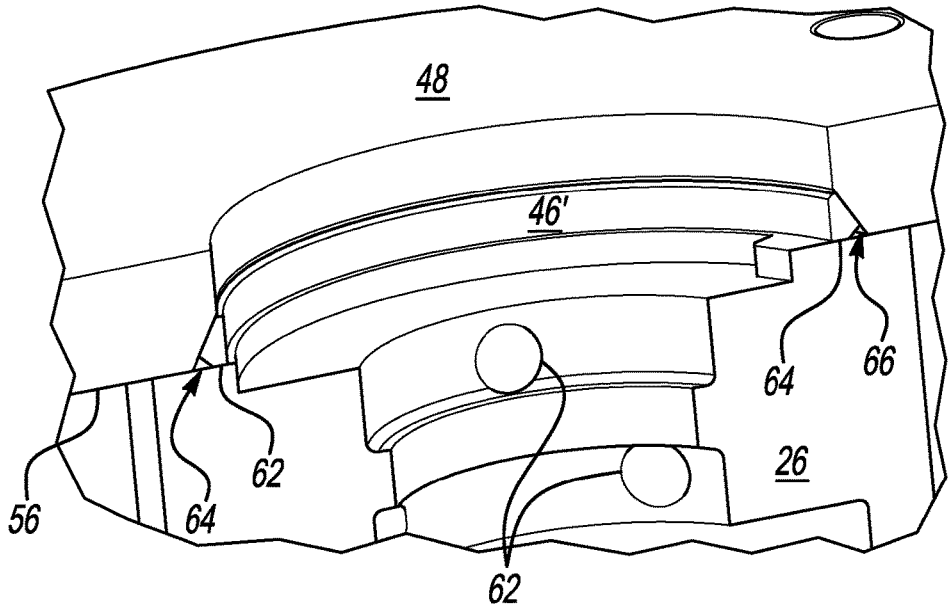
FIG. 5 is a perspective view depicting an implementation of a portion of a hydraulically-actuated VCT camshaft phaser including another implementation of an end plate seal.

A rotor fluid pathway 62 can be formed within the rotor 26 that fluidly connects the advancing chamber 36 to the retarding fluid chamber 38. As noted above, when engine oil pressure supplied to the hydraulically-actuated VCT assembly 12 falls below a particular threshold, the assembly 12 can draw engine oil from the advancing chamber 36 and communicate that fluid to the retarding fluid chamber 38 through the rotor fluid pathway 62 or vice-versa thereby preventing the introduction of air into the assembly 12. Fluid can flow from the chamber 36, 38 having higher relative pressure to the chamber 36, 38 having a relatively lower relative pressure Turning to FIG. 5, another implementation of the end plate seal 46' is shown. A radial surface 64 of the end plate seal 46' includes a fluid groove 66 positioned in between the seal 46' and the radial surface 56 of the rotor 26. The fluid groove 66 can be created by chamfering an edge of the end plate seal 46'. The fluid groove 66 can permit the flow of fluid between the advancing chamber 36 and the retarding chamber 38 (shown in FIG. 1). The fluid groove 66 can help prevent the introduction of air into the chambers by providing a secondary fluid source when oil pressure may be inadequate.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A hydraulically-actuated variable camshaft timing (VCT) assembly, comprising:

a stator having one or more fluid chambers;

a rotor received by the stator, and configured to be angularly displaced relative to the stator, having one or more radially extending vanes positioned within the fluid chambers;

an end plate coupled with the stator and at least partially defining the fluid chambers;

an end plate seal abutting the end plate and a radial surface of the rotor; and a seal groove that receives the end plate seal and encircles an axis of camshaft rotation.

2. The hydraulically-actuated VCT assembly recited in claim 1, wherein the seal groove includes a planar surface that biases the end plate seal in both an axial and radial direction.

3. The hydraulically-actuated VCT assembly recited in claim 1, wherein the end plate seal has a non-circular cross section.

4. The hydraulically-actuated VCT assembly recited in claim 3, wherein the end plate seal has a fluid groove.

5. The hydraulically-actuated VCT assembly recited in claim 4, wherein the fluid groove is a chamfered edge.

6. The hydraulically-actuated camshaft phaser recited in claim 1, further comprising a rotor fluid pathway formed within the rotor permitting the flow of fluid from one of the one or more fluid chambers having a higher relative pressure to another of the one or more fluid chambers having a relatively lower relative pressure.

7. A hydraulically-actuated variable camshaft timing (VCT) assembly, comprising:

a stator having one or more fluid chambers;

a rotor received by the stator, and configured to be angularly displaced relative to the stator, having one or more radially extending vanes positioned within the fluid chambers;

an end plate coupled with the stator and at least partially defining the fluid chambers;

a seal groove, having an angled planar surface, formed in the end plate; and an end plate seal received within the seal groove abutting the angled planar surface and a radial surface of the rotor.

8. The hydraulically-actuated VCT assembly recited in claim 7, wherein the end plate seal has a non-circular cross section.

9. The hydraulically-actuated VCT assembly recited in claim 8, wherein the end plate seal has a fluid groove.

10. The hydraulically-actuated VCT assembly recited in claim 9, wherein the fluid groove is a chamfered edge.

11. The hydraulically-actuated camshaft phaser recited in claim 7, further comprising a rotor fluid pathway formed within the rotor permitting the flow of fluid from a fluid chamber having a higher relative pressure to a fluid chamber having a relatively lower relative pressure.

* * * * *